US008469079B2

(12) United States Patent
Hinson, Jr.

(10) Patent No.: US 8,469,079 B2
(45) Date of Patent: Jun. 25, 2013

(54) SYSTEM AND METHOD FOR CLEANING, TESTING, AND REUSING RISER TUBES WITH ALUMINUM BUILD UP

(75) Inventor: Robert Hinson, Jr., Hartsville, SC (US)

(73) Assignee: Honda Motor Co., Ltd., Tokyo (JP)

( * ) Notice: Subject to any disclaimer, the term of this patent is extended or adjusted under 35 U.S.C. 154(b) by 74 days.

(21) Appl. No.: 13/072,635

(22) Filed: Mar. 25, 2011

(65) Prior Publication Data

US 2011/0168209 A1 Jul. 14, 2011

Related U.S. Application Data

(62) Division of application No. 12/127,192, filed on May 27, 2008, now abandoned.

(51) Int. Cl.
*B22D 43/00* (2006.01)

(52) U.S. Cl.
USPC ..... 164/4.1; 164/121; 164/158

(58) Field of Classification Search
USPC ..... 164/4.1, 121, 158
See application file for complete search history.

(56) References Cited

U.S. PATENT DOCUMENTS

| | | | | |
|---|---|---|---|---|
| 2,031,019 | A | 2/1936 | Walker et al. | |
| 3,085,272 | A | 4/1963 | Weichselbaum | |
| 3,153,602 | A * | 10/1964 | Duckett | 134/5 |
| 3,184,596 | A * | 5/1965 | Alburger | 250/302 |
| 4,313,975 | A | 2/1982 | Mairy | |
| 4,368,834 | A * | 1/1983 | Daussan et al. | 222/593 |
| 4,599,967 | A | 7/1986 | Murphy et al. | |
| 5,429,174 | A | 7/1995 | Wahnsiedler | |
| 5,435,373 | A | 7/1995 | Drane et al. | |
| 5,558,801 | A * | 9/1996 | Tsukahara et al. | 222/607 |
| 6,024,259 | A * | 2/2000 | Gardner et al. | 222/590 |
| 7,045,022 | B2 | 5/2006 | Breslin et al. | |
| 2006/0220401 | A1 | 10/2006 | Schwartz | |

FOREIGN PATENT DOCUMENTS

JP 01317672 A * 12/1989

OTHER PUBLICATIONS

Kubota Corporation, "Ceramic Stalk for Aluminum Low Pressure Casting", Internet Archive dated Oct. 7, 2006, <http://www.kubota.co.jp/infra/shinsozai/ceramics/stalk/stalk2_e.html>, accessed Jun. 2, 2012.*

Niedbalski, Eric, "Is Penetrant Testing Still Relevant?", Oct. 1, 2006, Quality Magazine, <http://www.qualitymag.com/CDA/Articles/Supplement/e4a36e9d3e16e010VgnVCM100000f932a8c0_>, accessed Jun. 2, 2012.*

Campbell, John. Castings Practice: The Ten Rules of Castings, Butterworth-Heinemann, Apr. 16, 2004, pp. 112-113.*

"Safe Handling of Equipment", Safety Manual, Maryland Public Schools, <http://www.mdk12.org/instructions/curriculum/science/safety/handling.html>, Internet Archive dated back to Mar. 8, 2004.

Office Action of U.S. Appl. No. 12/127,192, filed Apr. 28, 2011.

* cited by examiner

*Primary Examiner* — Keith Walker
*Assistant Examiner* — Jacky Yuen
(74) *Attorney, Agent, or Firm* — Rankin, Hill & Clark LLP

(57) ABSTRACT

A cleaning system and method for cleaning die cast metal waste from an interior of a die cast machine riser tube is provided whereby the cleaning system includes a riser tube stand, a heating means, a cleaning tool and leak test materials. The method includes heating the riser tube to a predetermined temperature to melt away the waste and cleaning the remaining residue with the cleaning tool.

13 Claims, 4 Drawing Sheets

SYSTEM AND METHOD FOR CLEANING, TESTING, AND REUSING RISER TUBES WITH ALUMINUM BUILD UP

This application is a divisional of U.S. application Ser. No. 12/127,192 filed on May 27, 2008, which is expressly incorporated herein by reference.

BACKGROUND OF THE INVENTION

1. Field of the Invention

The present invention relates to a die casting machine riser tube. More specifically, the present invention relates to a cleaning system and method for cleaning residual aluminum from the interior of a die casting machine riser tube.

2. Description of Related Art

In aluminum die casting applications in the automotive industry, low pressure riser tubes generate a build up of aluminum on the inside surface of the riser tube. The aluminum build up disrupts the flow of aluminum through the riser tube to the casting machine thereby by decreasing the efficiency of the casting process. Thus, the riser tubes must be frequently replaced with new riser tubes in order to maintain the efficiency of the casting process. The cost of replacing existing riser tubes with new riser tubes increases manufacturing costs, which in turn increases the cost of the automobile to the consumer. Therefore, what is required is a cleaning system and method to efficiently clean and refurbish existing riser tubes such that the refurbished riser tubes operate as efficiently as new riser tubes without sacrificing quality.

SUMMARY OF THE INVENTION

In accordance with one aspect, the present invention overcomes the above mentioned disadvantages by providing a method for removing die cast metal waste from an interior of a die cast machine riser tube. The riser tube has of an elongated cylindrical section with an inside surface and an outside surface, and a top portion connected to a top of the elongated cylindrical section whereby the top portion has an outer diameter larger than the outer diameter of the elongated cylindrical section.

The method includes the steps of removing the riser tube from the die cast machine, inserting the riser tube into a riser tube stand such that the top portion of the riser tube rests on a top circular portion of the riser tube stand, securing a heating means to the top portion of the riser tube, heating the interior of the riser tube to a temperature suitable to melt the die cast metal waste on an inside surface of the elongated cylindrical section of the riser tube, cooling the riser tube, scraping away left over residue from the inside surface of the elongated cylindrical section of the riser tube, performing a leak test on the riser tube with leak test materials, applying a release agent to the inside surface of the elongated cylindrical section of the riser tube, and re-installing the riser tube on to the die cast machine.

In accordance with another aspect, the present invention provides a cleaning system to clean die cast metal waste from an interior of a die cast machine riser tube. The cleaning system includes a riser tube stand including a circular top portion having an opening defined in the center thereof to accept the riser tube, and multiple legs attached to the circular top portion at equally space intervals around the circular top portion, a heating means to heat the interior of the riser tube, a cleaning tool having a handle portion, middle portion having a rough portion, and a lower portion having a shape in the form of a chisel, and leak test materials to test the quality of the riser tube.

Additional benefits and advantages of the present invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings that form a part of the specification.

DETAILED DESCRIPTION OF THE INVENTION

Figure 1:
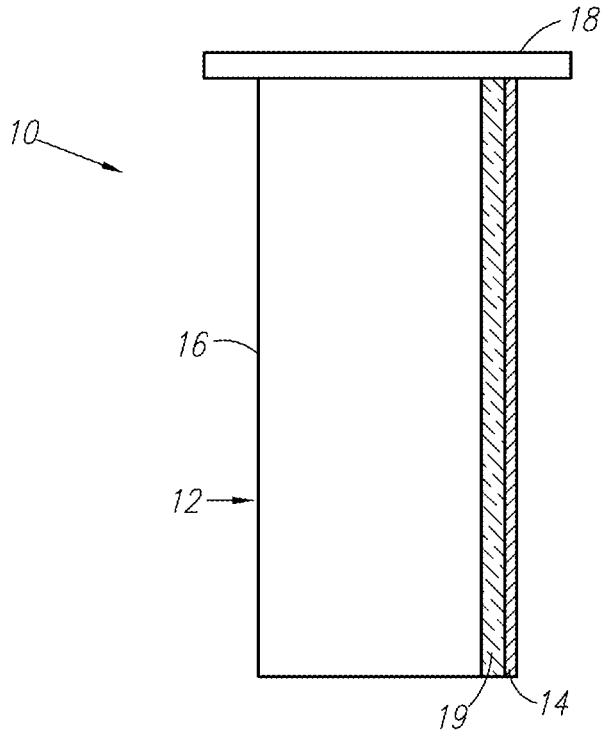
FIG. 1 is a schematic view of a die cast machine riser tube showing accumulation of aluminum build up on an inside surface of the riser tube.
Figure 2:
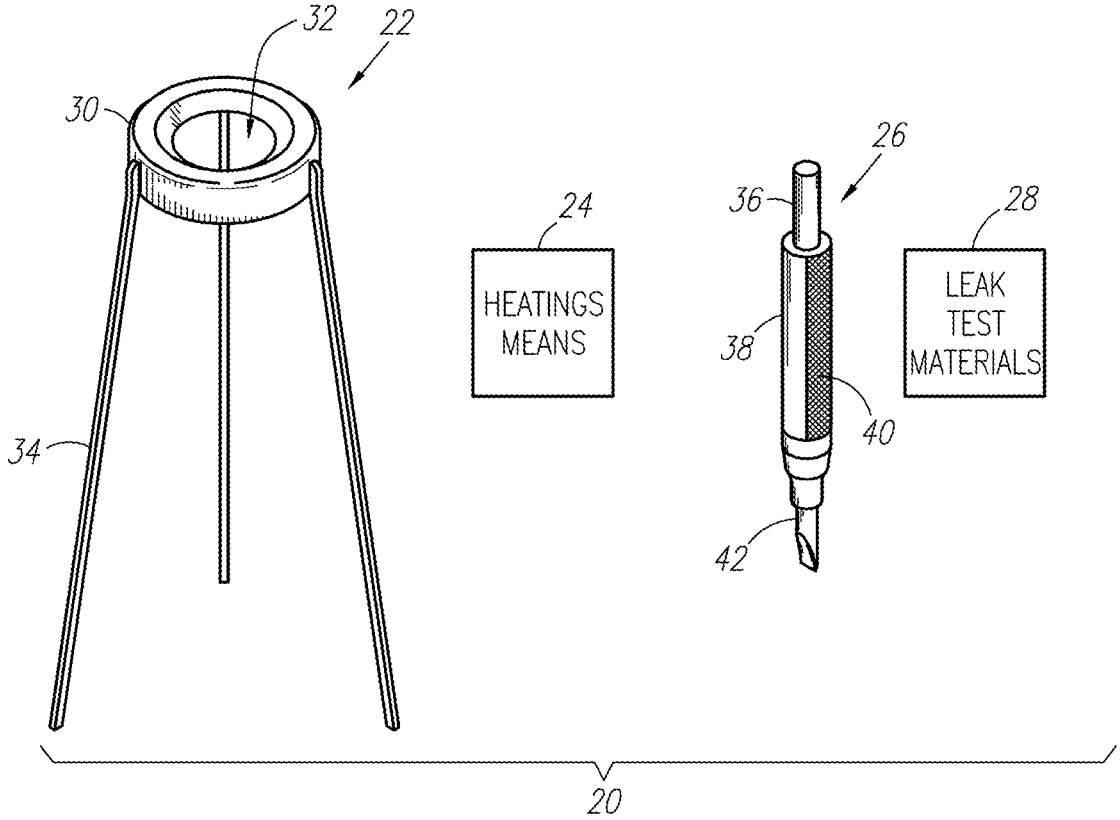
FIG. 2 is a view showing the components required for a riser tube cleaning system in accordance with the present invention.

Referring to FIGS. 1 and 2, the present invention includes a cleaning system 20 and method to clean an interior of a die casting machine riser tube 10. As previously mentioned, in aluminum die casting applications in the automotive industry, low pressure riser tubes generate a build up of aluminum on the inside surface of the riser tube. The aluminum build up disrupts the flow of aluminum through the riser tube to the casting machine thereby decreasing the efficiency of the casting process.

Referring to FIG. 1, the riser tube 10 includes an elongated cylindrical section 12 having an inside surface 14 and an outside surface 16. The riser tube 10 further includes a top or flange portion 18 connected to the top of the elongated cylindrical section 12 whereby the top portion 18 has an outer diameter larger than the outer diameter of the elongated cylindrical section 12. FIG. 1 schematically illustrates the aluminum build up 19 on the inside surface 14 of the riser tube 10 after several months of operation. It should be noted that the aluminum build up is generated on the entire inside surface 14 but is schematically shown only on one side in FIG. 1 for simplicity.

Referring to FIG. 2, the cleaning system 20 includes a riser tube stand 22, a heating means 24, a cleaning tool 26, and leak test materials 28. The riser tube stand 22 includes a circular top portion 30 with an opening 32 defined in the center thereof to accept a riser tube 10, and multiple legs 34 attached to the circular top portion 30 at equally spaced intervals around the circular top portion 30. The riser tube stand 22 can be made from any suitable material commonly known in the art, such as but not limited to steel.

Figure 3:
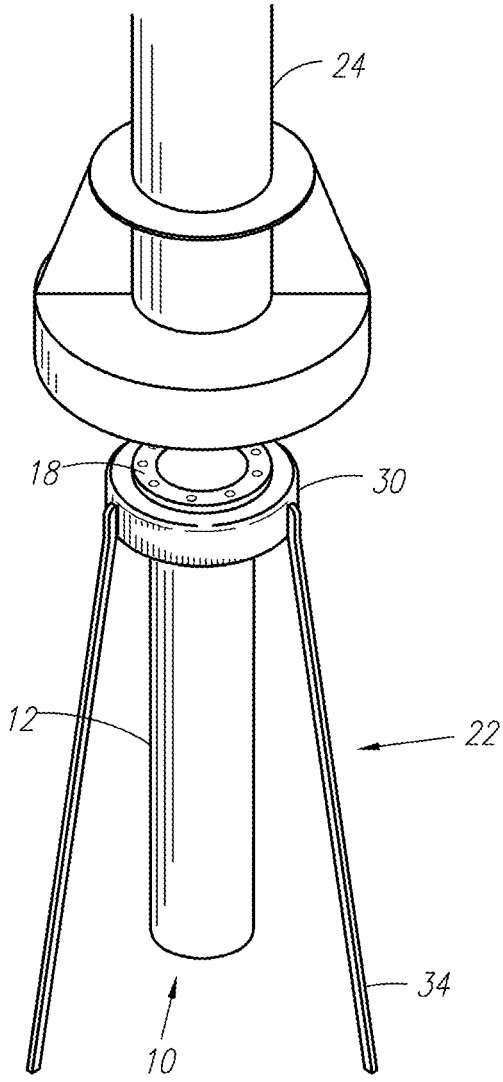
FIG. 3 is a perspective view of the riser tube inserted into the riser tube stand and the heating means over the riser tube but not attached.

During the cleaning process, the heating means 24 is placed over the riser tube, as shown in FIG. 3. The heating means 24 is then lowered onto the riser tube 10 and is attached to the top portion 18 of the riser tube 10 such that the heat generated by the heating means 24 is contained in the interior of the riser tube 10. The heating means may be any suitable heating means 24 commonly known in the art, such as but not limited to a propane heater. The heating means 24 must be capable of heating the aluminum build up to approximately 580° C. so as to melt off the aluminum from the interior of the riser tube 10.

The cleaning tool 26 is designed to remove the left over residue after the heating process is complete and the aluminum has been melted away. The cleaning tool 26 is an integrated piece and includes a handle portion 36, a middle portion 38 that includes a rough portion 40, and a lower or scraping portion 42 in the shape of a chisel. The chiseled lower portion 42 is used to remove the hard dross that results from the build up and subsequent removal of the aluminum and the rough portion 40 of the middle portion 38 is used to remove the remaining residual build up.

The leak test materials 28 are used to detect a potential crack or hole in the riser tube 10 after the cleaning process is complete. The leak test materials 28 include a penetrent that is applied to the inside surface 14 of the riser tube 10 and a developer that is applied to an outside surface 16 of the riser tube 10. Further details of the leak test will be described further below.

Referring to FIGS. 3-6, the method for cleaning the riser tube 10 with the above mentioned cleaning system 20 will be appreciated by the following description.

Figure 4:
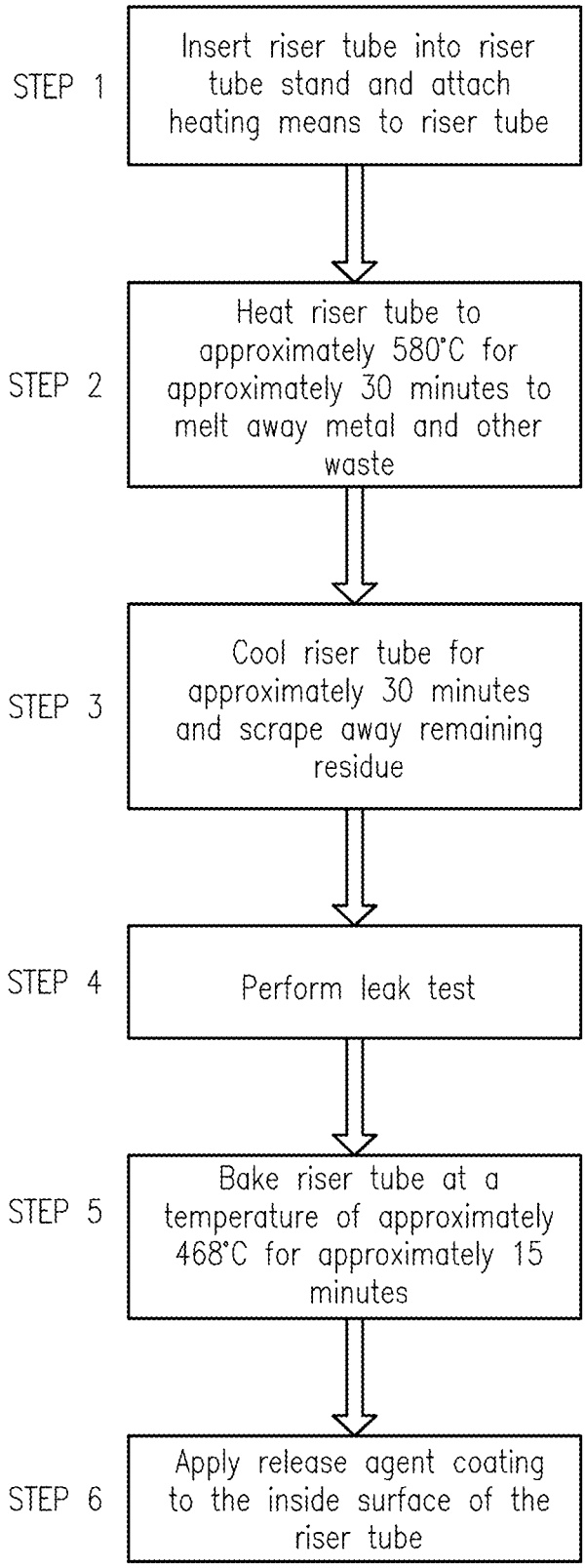
FIG. 4 is a flow chart illustrating a cleaning method with the disclosed cleaning system.

Referring to FIGS. 3 and 4, in Step 1, after the riser tube 10 has been removed from the die casting machine the riser tube 10 is inserted through the opening 32 in the circular top portion 30 of the riser tube stand 22 such that the top portion 18 of the riser tube 10 rests on the circular top portion 30. The heating means 24 is then placed on the top portion 18 of the riser tube 10 and is secured to the top portion 18 by any commonly known means. As previously mentioned, the heating means 24 is secured to the top portion 18 of the riser tube 10 such that the heat generated by the heating means 24 is directed into and contained in the interior of the riser tube 10.

Figure 5:
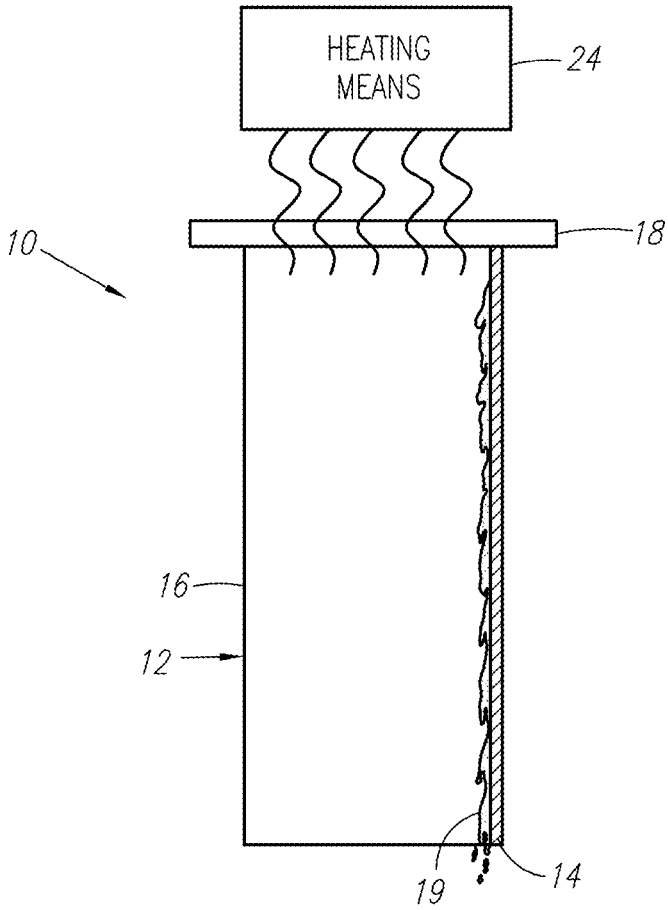
FIG. 5 is a schematic view of the heating means and the riser tube.

In Step 2 the riser tube 10 is then heated to a temperature of approximately 580° C. for approximately 30 minutes to thereby melt the aluminum build up. FIG. 5 schematically shows the heating means 24 heating the riser tube 10 thereby melting away the aluminum build up. As the aluminum build up melts it drains out of the bottom of the riser tube 10 and is collected in a proper container (not shown) below the riser tube 10 and is then properly discarded.

In Step 3 the riser tube 10 is cooled for 30 minutes to allow the remaining residue (dross and oxidation) to reform into a brittle state whereby the dross and oxidation can be easily scraped away using the cleaning tool 26. Further description of the aluminum build up before Step 2 (the heating process) and the left over residue after the cooling process (Step 3) on the inside surface 14 of the riser tube 10 is explained further below in reference to FIG. 6.

In step 4 the leak test is performed. As mentioned above, the penetrent is applied to the inside surface 14 of the riser tube 10 and the developer is applied to the outside surface 16 of the riser tube 10. In the event that a crack or hole exists in the riser tube the penetrent and developer will react at the point of the crack or hole. The reaction will create a dark red color along the crack or hole thereby indicating that the riser tube 10 has a leak and is therefore defective. Conversely, the absence of the dark red reaction indicates that there is no crack or hole, which indicates that the riser tube 10 does not have a leak and is not defective and may be re-used.

In step 5 the riser tube is baked for approximately 15 minutes at a temperature of approximately 468° C. This process neutralizes the penetrent and developer so that a releasing agent 44, shown in FIG. 1, may be applied to the inside surface 14 of the riser tube 10.

In Step 6 the above mentioned releasing agent 44 is applied to the inside surface 14 of the riser tube 10. The releasing agent protects the inside surface 14 of the riser tube 10 for approximately three months. The releasing agent also helps prevent the aluminum build up and solder from sticking to the inside surface 14 of the riser tube 10. The releasing agent may be any type of suitable releasing agent commonly known in the industry, such as but not limited to Boron Nitrite.

Figure 6:
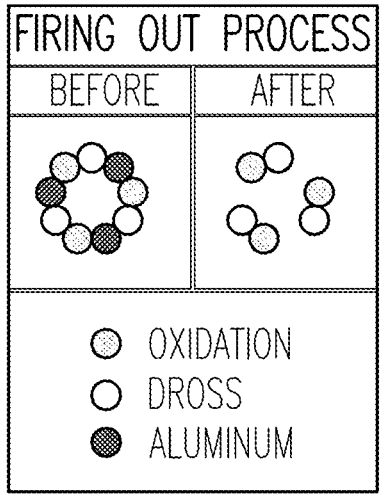
FIG. 6 schematically shows the aluminum build up on an inside surface of the riser tube before the cleaning process and the left over residue after the cleaning process.

Referring to FIG. 6, FIG. 6 schematically shows the waste build up on the inside surface 14 of the riser tube 10 before and after the heating process. Before the heating process the waste build up includes aluminum, dross and oxidation. The build up of aluminum also creates a solder effect whereby the solder binds the dross and the oxidation together thereby making it difficult to remove. Melting away the aluminum build up, however, also melts away the solder that binds the dross and the oxidation. As the remaining dross and oxidation cool they reform into a brittle state. In this state, therefore, the dross and oxidation can be easily removed using the cleaning tool 26 as described above.

While specific embodiments of the invention have been described and illustrated, it is to be understood that these embodiments are provided by way of example only and that the invention is not to be construed as being limited but only by proper scope of the following claims.

What is claimed is:

1. A method for removing die cast metal waste from an interior of a die cast machine riser tube comprising:

providing a riser tube comprised of an elongated cylindrical section having an inside surface and an outside surface, and a top portion connected to a top of the elongated cylindrical section whereby the top portion has an outer diameter larger than the outer diameter of the elongated cylindrical section;

removing the riser tube from a die cast machine;

inserting the riser tube into a riser tube stand which is separate from the die cast machine such that the top portion of the riser tube rests on a top circular portion of the riser tube stand;

securing a heating means to the top portion of the riser tube;

heating the interior of the riser tube to a temperature suitable to melt the die cast metal waste on an inside surface of the elongated cylindrical section of the riser tube;

cooling the riser tube;

scraping away left over residue from the inside surface of the elongated cylindrical section of the riser tube;

performing a leak test on the riser tube with leak test materials;

applying a release agent to the inside surface of the elongated cylindrical section of the riser tube, wherein prior to applying a release agent to the inside surface of the elongated cylindrical section of the riser tube, the method further includes baking the riser tube after performing the leak test at a temperature suitable to neutralize the leak test materials for a predetermined period of time; and re-installing the riser tube on to the die cast machine.

2. The method of claim 1, wherein prior to applying a release agent to the inside surface of the elongated cylindrical section of the riser tube, the method further includes baking the riser tube to a temperature of approximately 468° for approximately 15 minutes to neutralize the leak test materials.

3. The method of claim 2, wherein during heating the interior of the riser tube, the interior of the riser tube is heated to a temperature of approximately 580° for a predetermined period of time.

4. The method of claim 3, wherein during cooling of the riser tube, the riser tube is cooled for a predetermined period of time such that the left over residue reforms into a brittle state.

5. The method of claim 4, wherein the step of performing a leak test on the riser tube with leak test materials comprises:

applying a penetrant to the inside surface of the elongated cylindrical section;

applying a developer to the outside surface of the elongated cylindrical section; and determining if a crack or hole exists in the elongated cylindrical section of the riser tube.

6. The method of claim 5, wherein in determining if a crack or hole exists in the elongated cylindrical section of the riser tube, a crack is determined if the penetrant and developer react to create a dark red color along the crack or hole, and wherein the absence of the dark red reaction indicates that there is no crack or hole.

7. The method of claim 6, wherein the die cast metal is aluminum, and wherein the interior of the riser tube is heated with a propane heater.

8. A method for cleaning and testing a die casting riser tube, comprising:

removing the riser tube from a die cast machine prior to heating the riser tube;

installing the riser tube in a tripod shaped riser tube stand which is separate from the die cast machine;

heating the riser tube to melt build up on an inside surface of the riser tube, wherein heating of the riser tube includes securing a heating device to the riser tube and heating an interior of the riser tube to a temperature of approximately 580° for approximately 30 minutes;

cooling the riser tube;

scraping away remaining residue from the inside surface of the riser tube;

performing a leak test on the riser tube;

applying a release agent to the inside surface of the riser tube after performing the leak test on the riser tube; and baking the riser tube prior to applying the release agent to the inside surface of the riser tube to neutralize leak test materials used on the riser tube during the leak test.

9. The method of claim 8 wherein the riser tube includes an elongated cylindrical section having the inside surface of the riser tube and a top portion having an outer diameter larger than an outer diameter of the elongated cylindrical section, and wherein the riser tube stand includes an annular support portion and three spaced apart legs depending downward from the support portion to hold the support portion in an elevated position, and further wherein installing the riser tube in the riser tube stand includes inserting the cylindrical section of the riser tube through an aperture defined through the annular support portion and resting the top portion of the riser tube on the annular support portion, the legs of the riser tube stand each having an length greater than a length of the cylindrical section of the riser tube depending downward from the top portion of the riser tube.

10. The method of claim 8 further including re-installing the riser tube onto the die cast machine after the riser tube passes the leak test.

11. The method of claim 8 wherein the heating device is a propane heater.

12. The method of claim 8 wherein performing the leak test includes:

applying a penetrant to the inside surface of the riser tube;

applying a developer to an outside surface of the riser tube, the outside surface opposite the inside surface; and determining if a structural integrity of the riser tube is sufficient to reuse the riser tube.

13. The method of claim 12 wherein determining if the structural integrity of the riser tube is sufficient to reuse the riser tube includes observing a colored reaction between the penetrant and the developer, which correlates to a leak condition, or observing no colored reaction, which correlates to a no leak condition.

* * * * *